US011585589B2

(12) United States Patent
Lundqvist et al.

(10) Patent No.: US 11,585,589 B2
(45) Date of Patent: Feb. 21, 2023

(54) HANDLE ASSEMBLY AND CABINET DOOR FOR REFRIGERATION APPARATUS AND REFRIGERATION APPARATUS ASSEMBLY

(71) Applicants: Dometic Sweden AB, Solna (SE); Dometic (Zhuhai) Technology Co., Ltd., Guangdong (CN)

(72) Inventors: Anton Lundqvist, Solna (SE); Samuele Meda, Solna (SE); Peng Wang, Zhuhai (CN); Xiaoli Weng, Zhuhai (CN)

(73) Assignee: Dometic Sweden AB, Solna (SE)

( * ) Notice: Subject to any disclaimer, the term of this patent is extended or adjusted under 35 U.S.C. 154(b) by 487 days.

(21) Appl. No.: 16/678,493

(22) Filed: Nov. 8, 2019

(65) Prior Publication Data

US 2020/0149334 A1 May 14, 2020

(30) Foreign Application Priority Data

Nov. 9, 2018 (CN) ..... 201821852424.0

(51) Int. Cl.
*F25D 23/02* (2006.01)
*E05B 65/00* (2006.01)

(52) U.S. Cl.
CPC ..... *F25D 23/028* (2013.01); *E05B 65/005* (2013.01); *E05Y 2900/31* (2013.01); *F25D 2323/022* (2013.01); *F25D 2400/14* (2013.01)

(58) Field of Classification Search
CPC ..... F25D 17/047; F25D 23/028; F25D 2323/022; F25D 2400/14; E05Y 2900/31;
(Continued)

(56) References Cited

U.S. PATENT DOCUMENTS 2,136,662 A * 11/1938 Anderson ..... E05B 65/005 292/64
2,186,795 A * 1/1940 Anderson ..... E05C 5/00 292/64

(Continued)

FOREIGN PATENT DOCUMENTS

CA 2582586 A1 10/2007
CN 105064791 A * 11/2015

(Continued)

OTHER PUBLICATIONS

Notification to Grant Patent Right for UM Application No. 201821852424.0 dated Sep. 26, 2019.

(Continued)

*Primary Examiner* — Andrew M Roersma
(74) *Attorney, Agent, or Firm* — Dinsmore & Shohl LLP

(57) ABSTRACT

The present embodiments relate to a handle assembly for a refrigeration apparatus. The handle assembly can be detachably assembled on either side of a cabinet door of the refrigeration apparatus, the handle assembly comprising: a handle, a handle bracket, and an elastic member, wherein the handle comprises a handle portion and an extension on a side of the handle portion, characterized in that the handle is movably assembled in the handle bracket, wherein the handle portion of the handle is assembled in a first portion of the handle bracket, and the extension of the handle is assembled in a second portion of the handle bracket, and a protrusion is disposed at one end of the extension; and the elastic member is assembled in the second portion of the handle bracket, and the extension of the handle is connected with the elastic member. The present embodiments can realize the opening of the cabinet door of the refrigeration apparatus in two directions, thereby overcoming the disadvantage that it is difficult to open the cabinet door of the (Continued)

refrigeration apparatus due to restriction by the opening direction of the cabinet door in a small space, especially in an in-vehicle environment.

10 Claims, 4 Drawing Sheets

(58) Field of Classification Search
CPC ..... E05B 65/005; E05B 17/0037; Y10T 292/096; Y10T 292/0969; Y10T 292/0977; Y10T 292/1016; Y10S 292/63; E05C 1/00; E05C 1/08
See application file for complete search history.

(56) References Cited

U.S. PATENT DOCUMENTS

| | | | | | |
|---|---|---|---|---|---|
| 2,252,591 | A * | 8/1941 | Anderson | E05B 65/0042 | 292/DIG. 37 |
| 2,293,402 | A * | 8/1942 | Parsons | E05B 65/0042 | 292/DIG. 49 |
| 3,048,898 | A * | 8/1962 | Davis | E05D 15/502 | 16/230 |
| 3,403,473 | A * | 10/1968 | Navarro | E05D 15/502 | 16/230 |
| 4,151,681 | A * | 5/1979 | Roberts | F25D 23/028 | 49/501 |
| 4,486,041 | A * | 12/1984 | Takasaki | E05C 3/162 | 292/336.3 |
| 5,921,095 | A * | 7/1999 | Lee | F25D 29/005 | 62/DIG. 13 |
| D422,288 | S | 4/2000 | Alvring et al. | | |
| 6,053,544 | A | 4/2000 | Alvring et al. | | |
| D440,238 | S | 4/2001 | Alvring et al. | | |
| 6,296,285 | B1 | 10/2001 | Alvring et al. | | |
| 8,523,302 | B2 * | 9/2013 | Shin | F25D 23/028 | 49/276 |
| 10,550,612 | B2 | 2/2020 | Reske et al. | | |
| 2007/0227208 | A1 | 10/2007 | Ostberg | | |
| 2007/0295024 | A1 | 12/2007 | Hallin et al. | | |
| 2008/0000052 | A1 * | 1/2008 | Hong | F25D 23/028 | 16/382 |
| 2019/0086139 | A1 | 3/2019 | Xingbiao et al. | | |
| 2019/0178564 | A1 | 6/2019 | Steiger et al. | | |

FOREIGN PATENT DOCUMENTS

| | | | | | |
|---|---|---|---|---|---|
| CN | 106440643 | A | * | 2/2017 | |
| CN | 106500441 | A | * | 3/2017 | F25D 11/00 |
| CN | 107062775 | A | * | 8/2017 | F25D 23/028 |
| CN | 107246184 | A | * | 10/2017 | E05B 5/00 |
| CN | 207277989 | U | * | 4/2018 | |
| CN | 108756461 | A | * | 11/2018 | |
| CN | 109642768 | A | | 4/2019 | |
| DE | 10256954 | A1 | | 10/2003 | |
| EP | 1873468 | A2 | | 1/2008 | |
| EP | 2896917 | A1 | | 7/2015 | |
| EP | 3287722 | A1 | | 2/2018 | |
| JP | 2008008610 | A | | 1/2008 | |
| WO | WO-2014194953 | A1 | * | 12/2014 | E05B 17/0033 |
| WO | 2017029626 | A1 | | 2/2017 | |
| WO | 2018037038 | A1 | | 3/2018 | |

OTHER PUBLICATIONS

CN UM Application No. 201821852424.0 filed on Nov. 9, 2018 entitled "A handle assembly for the cooling equipment, the equipment door and the cooling equipment assembly".
U.S. Appl. No. 16/198,009, filed Nov. 21, 2018 titled "Molded Frame for a Reversible Appliance Door".
Dometic Catalog—Refrigerators—2015.
Dometic Catalog—Refrigerators—2016.

* cited by examiner

HANDLE ASSEMBLY AND CABINET DOOR FOR REFRIGERATION APPARATUS AND REFRIGERATION APPARATUS ASSEMBLY

TECHNICAL FIELD

The present embodiments relate to the technical field of refrigeration apparatus manufacturing, in particular to a handle assembly and a cabinet door for a refrigeration apparatus assembly and a refrigeration apparatus assembly.

BACKGROUND ART

For existing refrigeration apparatuses, the cabinet door is often opened by pulling a handle portion on a side of the cabinet door of the refrigeration apparatus, which only allows the cabinet door to open from one side of the refrigeration apparatus. However, when the space in which the refrigeration apparatus is located is crowded, especially in an in-vehicle environment, since an internal space of the vehicle body is limited, in order to properly utilize the interior space of the vehicle, it is usually necessary to move and reposition the refrigeration apparatus. When the cabinet door is opened only from one side and is restricted by the opening direction of the cabinet door when it is to be placed, that is, it may occur that it is difficult to open the cabinet door of the refrigeration apparatus after repositioning, so that the refrigeration apparatus cannot be used normally.

SUMMARY OF THE UTILITY MODEL

The instant embodiments aim to solve the above-mentioned technical problems in the related art at least to some extent. To this end, the present embodiments propose a new handle assembly, such that it realizes the opening of the cabinet door of the refrigeration apparatus in two directions by detachably assembling the handle assembly on either side of the cabinet door of the refrigeration apparatus, thereby enabling overcoming the disadvantage of being difficult to open the cabinet door of the refrigeration apparatus when being restricted by the opening direction of the cabinet door in a small space. Moreover, in the in-vehicle environment, since the vehicle is prone to shaking during driving, the magnetic stripe is usually not used to seal the cabinet door of the refrigeration apparatus but a lock tongue is used to lock the cabinet door, and the detachable handle assembly proposed by a present embodiment is especially suitable for use with the cabinet door that uses the lock tongue. In addition, the handle has the advantages of a simple structure, easy and reliable operation, detachability and low costs.

The present embodiments also proposes a cabinet door of a refrigeration apparatus that can be used cooperatively with the new handle assembly.

In order to realize the above object, according to a first aspect of the present embodiments, a handle assembly is proposed which can be detachably assembled on either side of a cabinet door of the refrigeration apparatus, the handle assembly comprising: a handle, a handle bracket, and an elastic member, wherein the handle comprises a handle portion and an extension on a side of the handle portion, characterized in that the handle is movably assembled in the handle bracket, wherein the handle portion of the handle is assembled in a first portion of the handle bracket, and the extension of the handle is assembled in a second portion of the handle bracket, and a protrusion is disposed at one end of the extension; the elastic member is assembled in the second portion of the handle bracket, and the extension of the handle is connected with the elastic member.

The handle assembly according to the present embodiments can be detachably assembled on either side of the cabinet door of the refrigeration apparatus to realize the opening of the cabinet door of the refrigeration apparatus in two directions, thereby enabling overcoming the disadvantage of being difficult to open the cabinet door of the refrigeration apparatus when being restricted by the opening direction of the cabinet door in a small space, especially in an in-vehicle environment. The handle also has the advantages of a simple structure, easy and reliable operation, detachability and low costs.

In addition, the handle assembly according to the present embodiments may also have the following additional technical features:

According to an aspect of the present embodiments, two sides of the extension of the handle engage in a buckle of the handle bracket and are slidable in the buckle.

According to an aspect of the present embodiments, the protrusion is substantially perpendicular to the extending direction.

According to an aspect of the present embodiments, the handle preferably has two extensions, and the elastic members are connected between the two extensions.

According to an aspect of the present embodiments, the elastic member is a torsion spring.

According to an aspect of the present embodiments, the handle bracket is provided with a flange edge between the first portion and the second portion thereof.

According to an aspect of the present embodiments, the handle bracket is provided with screw holes on two sides of the second portion thereof.

According to an aspect of the present embodiments, the handle assembly further comprises a decorative sheet.

According to a second aspect of the present embodiments, a cabinet door of a refrigeration apparatus that can be used cooperatively with the handle assembly according to the first aspect of the present embodiments is proposed, wherein the cooperative use causes a lock tongue of the cabinet door to retract to realize bi-directional opening of the cabinet door.

According to a third aspect of the present embodiments, a refrigeration apparatus assembly is proposed, the refrigeration apparatus comprises two refrigeration apparatuses disposed side by side, wherein the handle assembly according to the first aspect of the present embodiments is respectively assembled on adjacent sides of the two refrigeration apparatuses such that a cabinet door of the refrigeration apparatus assembly can be opened in opposite directions.

DETAILED DESCRIPTION OF EMBODIMENTS

Figure 1:
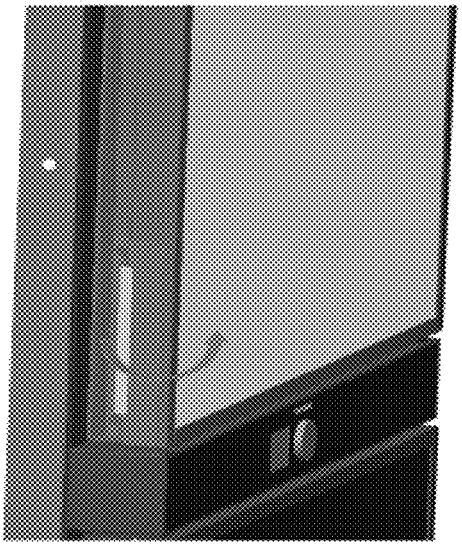
FIG. 1 is a schematic view of a cabinet door handle of prior art refrigeration apparatus.

The embodiments are described in detail below, and the examples of the embodiments are shown in the drawings, wherein the same or similar reference numerals indicate the same or similar elements or elements having the same or similar functions. The embodiments described below with reference to the drawings are exemplary, and intended to explain the present embodiments and are not to be construed as limiting the present embodiments.

FIG. 1 shows a cabinet door handle of a prior art refrigeration apparatus that is fixed to one side of the cabinet door of a refrigeration apparatus so that the cabinet door of the refrigeration apparatus is opened toward one side. When the refrigerator is located in a small space, especially in an in-vehicle environment, the cabinet door of the refrigeration apparatus cannot be normally opened when restricted by the opening direction of the cabinet door.

In order to solve the above disadvantages existing in the prior art, the present embodiments propose a new handle assembly. The handle assembly 1 according to the present embodiments will be described below with reference to FIGS. 2-7.

Figure 2:
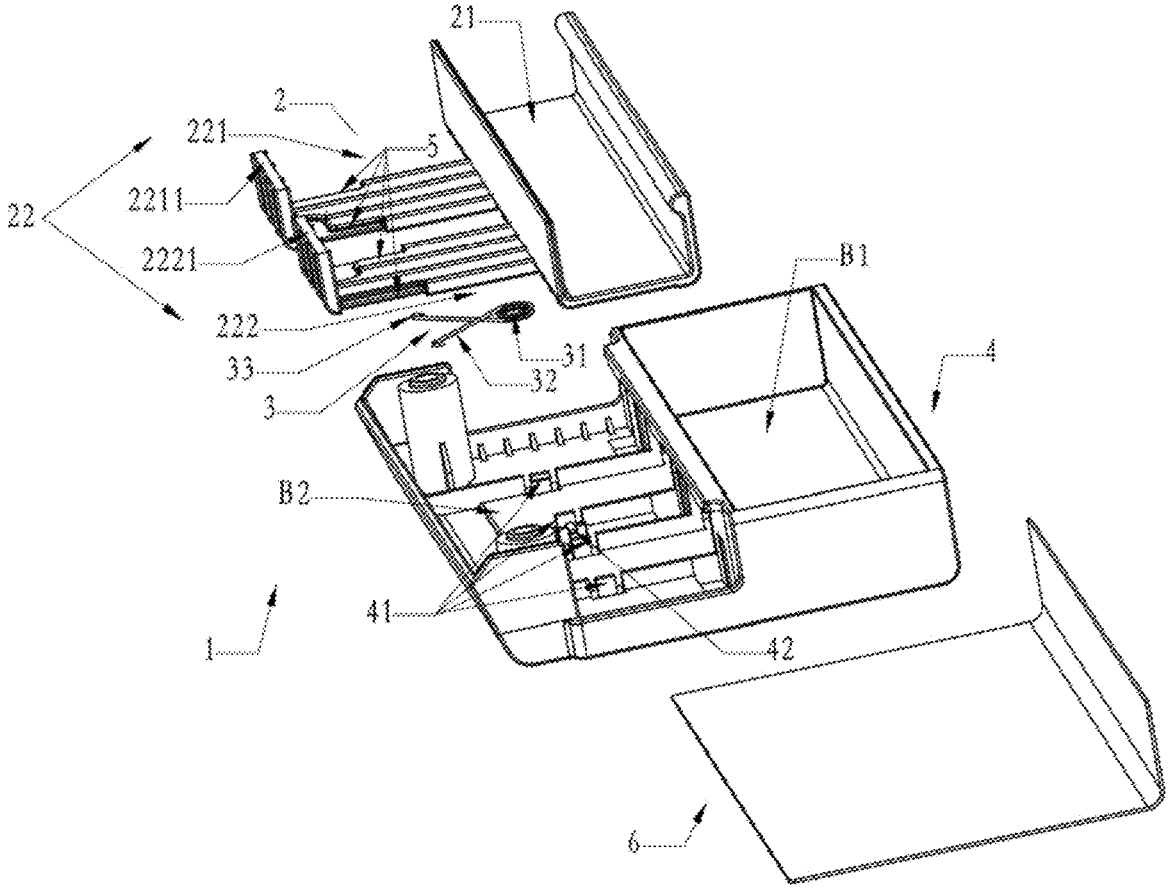
FIG. 2 is an exploded structural schematic view of a handle assembly according to the present embodiments.
Figure 3:
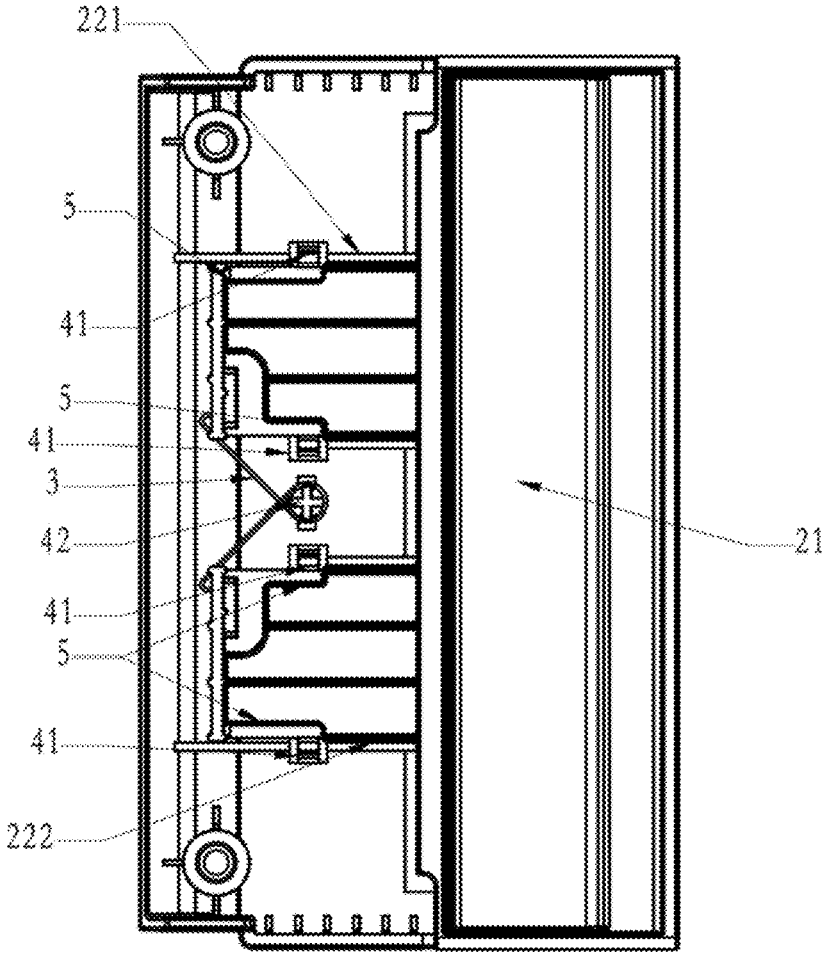
FIG. 3 is an assembled structural schematic view of the handle assembly according to the present embodiments.

As shown in FIG. 2, the handle assembly 1 according to the present embodiments includes a handle 2, a handle bracket 4 and an elastic member 3, wherein the handle 2 includes a handle portion 21 and an extension 22 on a side of the handle portion; and the present embodiments are described by two extensions 221, 222. Specifically, when the handle 2 is assembled in the handle bracket 4, the handle portion 21 is assembled to a first portion B1 of the handle bracket 4 and at a distance from an edge of the first portion B1, two side edges of each of the two extensions 221, 222 have recesses 5 extending along the extension respectively. The recesses 5 are used for snapping with the buckles 41 of a second portion B2 of the handle bracket 4 in a width direction. The recesses 5 realize movement of the handle 2 in a length direction, so that the handle 2 can be moved in the buckles in a direction substantially parallel to the handle bracket 4. Furthermore, when the elastic member 3, preferably a torsion spring, is assembled in the handle bracket 4, a spiral portion 31 of the torsion spring 3 is snapped within a buckle 42 of the second portion B2 of the handle bracket 4, wherein the buckle 42 is disposed between positions where the two extensions are assembled, and two spring arms 32, 33 of the torsion spring 3 are respectively connected to protrusions 2211, 2221 of the extensions 221, 222, wherein the two spring arms each has a shape of a hook at end thereof, and the torsion spring 3 is connected to the protrusions 2211, 2221 through spring arm ends having hooks in shape. The handle 2 can be returned by rebound through the torsion spring when released. The structure of the handle assembly 1 assembled according to the above disclosure is illustrated in FIG. 3.

Figure 4:
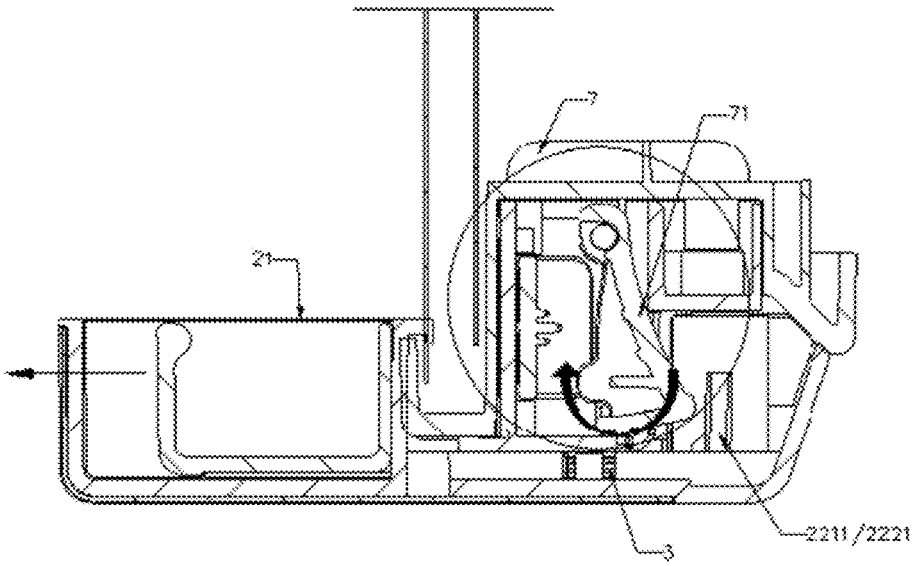
FIG. 4 is a cross-sectional view of the handle assembly according to the present embodiments cooperating with interior assemblies of the cabinet door of the refrigeration apparatus when in use.
Figure 5:
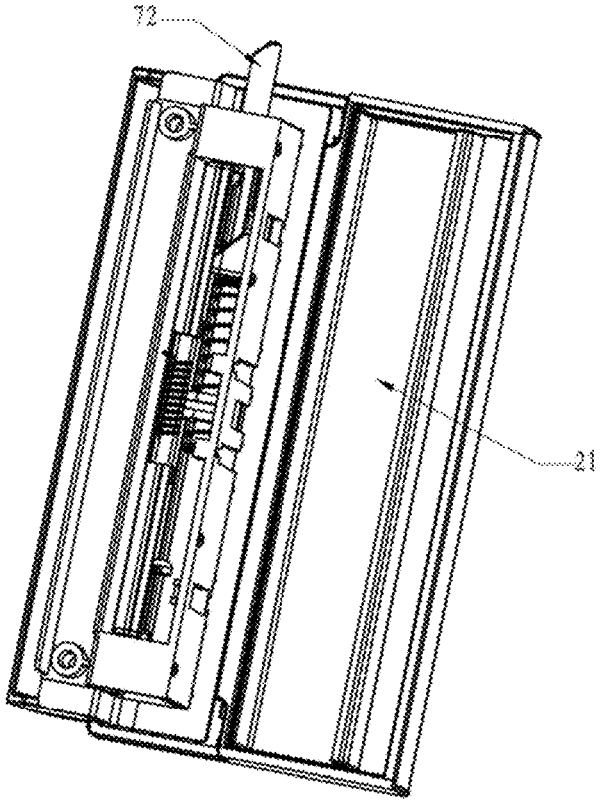
FIG. 5 is a schematic view of the handle assembly and lock tongue according to the present embodiments repositioned after opening the cabinet door of the refrigeration apparatus.

When the handle assembly 1 according to the present embodiments are used, as shown in FIG. 4, the side of the cabinet door of the refrigeration apparatus is snapped into the second portion B2 of the handle bracket 4 of the handle assembly 1. That is, the extensions 221, 222 of the handle 2 are arranged on the side of the cabinet door of the refrigeration apparatus, wherein the protrusions 2211, 2221 of the extensions 221, 222 are arranged between an interior assembly 7 of the cabinet door of the refrigeration apparatus and the refrigerator body. The first portion B1 of the handle bracket 4, the handle portion 21 of the handle 2 are thus located outside the cabinet door of the refrigeration apparatus. When the cabinet door of the refrigeration apparatus is opened, the handle portion 21 is pulled toward the outside of the cabinet door of the refrigeration apparatus, and since the handle 2 is movably arranged in the handle bracket 4, the extensions 221, 222 move as the handle portion 21 is pulled, and the protrusions 2211, 2221 of the extensions 221, 222 push an interior handle 71 in the interior assembly 7 of the cabinet door of the refrigeration apparatus to rotate during the movement so that the lock tongue 72 retracts to open the cabinet door of the refrigeration apparatus; and after the cabinet door of the refrigeration apparatus is opened, the handle portion 21 is released, and under the rebound action of the elastic member 3, the lock tongue 72 and the handle portion 21 are returned; as shown in FIG. 5.

Figure 6:
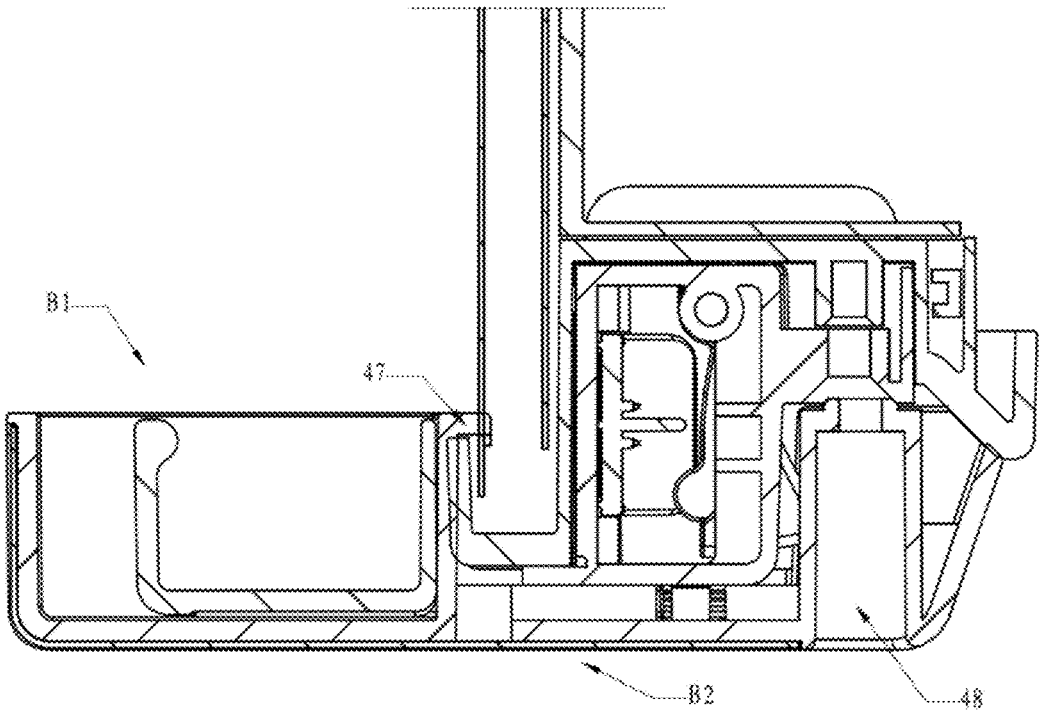
FIG. 6 is a cross-sectional view of the handle assembly according to the present embodiments detachably and fixedly assembled to the cabinet door of the refrigeration apparatus.

FIG. 6 shows an embodiment in which the handle assembly 1 is detachably assembled on either side of the cabinet door of the refrigeration apparatus. Specifically, the handle bracket 4 is additionally provided with a flange edge 47 between the first portion B1 and the second portion B2, the flange edge 47 being substantially L-shaped, that is, having a first segment substantially parallel to the handle bracket 4 and a second segment substantially perpendicular to the handle bracket 4. Furthermore, screw holes 48 may be also disposed on two sides of the second portion B2 of the handle bracket 4. Therefore, when the detachable handle assembly 1 is used, the second segment of the flange edge 47 snaps into a groove of the cabinet door surface of the refrigeration apparatus and/or the screws are screwed into the screw holes to fix the handle assembly 1 on the cabinet door of the refrigeration apparatus.

Figure 7:
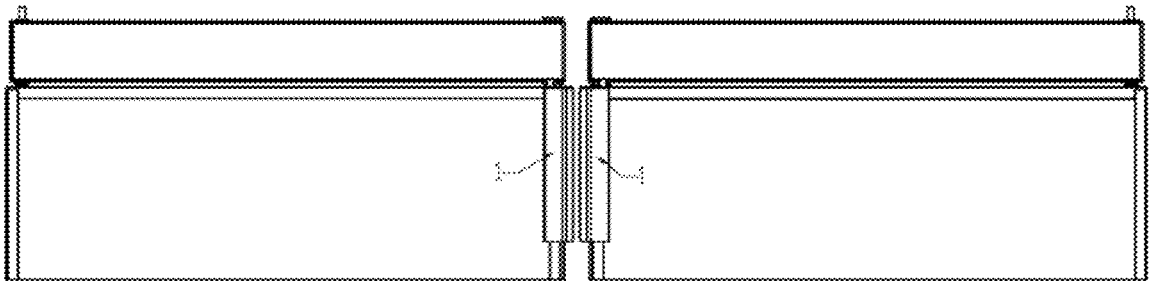
FIG. 7 is a structural schematic view of a double door refrigeration apparatus simulating by using and combining two refrigeration apparatuses with the handle assembly according to the present embodiments.

Furthermore, since the handle assembly according to the present embodiments can be detachably assembled on either side of the cabinet door of the refrigeration apparatus to open the cabinet door of the refrigeration apparatus in two directions, two separate refrigeration apparatuses can be combined side by side to form a double door refrigeration apparatus, wherein two handle assemblies are respectively assembled on two combined sides of the refrigeration apparatus. The two combined refrigeration apparatuses can open the cabinet door in a similar manner to a double door refrigeration apparatus, as shown in FIG. 7. The combined refrigeration apparatuses formed in this simple manner can achieve the effect of the double door refrigeration apparatus, and the cost thereof is significantly lower than the manufacturing cost of the double door refrigeration apparatus.

A decorative panel 6 may be disposed on an outer side of the handle bracket 4 to improve the appearance of the handle assembly 1.

Although the present disclosure describes an embodiment of a handle assembly structure having two extensions only with reference to the drawings, the handle assembly 1 may also employ a structure having, for example, three, four or more extensions, wherein each extension is connected by the elastic member as described above. Furthermore, the extensions may take any width suitable for ensuring that it has sufficient mechanical strength (which realizes the interior handle in the interior assembly of the cabinet door to rotate to open the cabinet door). Further, the widths of the extensions, the spacing between adjacent extensions and the spacing between the extensions and the edges of the second portion of the handle bracket are substantially the same in the entire width of the second portion of the handle bracket. That is, the widths of the extensions and the above spacings are substantially evenly distributed over the entire width of the second portion, so that the mechanical strength of the extensions can be ensured and the machining and manufacturing of the handle assembly of the present embodiments are facilitated. Furthermore, as described above, the recesses of the extension portions of the present embodiments realize the movement of the handle in the length direction. Specifically, the lengths of the recesses realize the pulling and returning of the handle, and thus, the lengths of the recesses can take any length suitable for realizing the pulling and returning of the handle. Similarly, the distance from the handle portion of the handle to the outer side of the first portion of the handle bracket can take any length suitable for realizing the pulling and returning of the handle.

Furthermore, in addition to the torsion spring described above and its connection manner, the present embodiments can also adopt any form of elastic member suitable for realizing the return by rebound of the handle assembly and its connection manner.

In the description of the present embodiments, it should be noted that orientations or position relationships indicated by terms such as "inside" and "outside" are based on orientations or position relationships shown in the drawings, which is only for convenience of describing the present embodiments and simplifying the description, rather than indicates or implies that devices or elements referred to have to be constructed and operated in a particular orientation, and therefore cannot be construed as limiting the present embodiments.

Furthermore, the terms "first" and "second" are used for descriptive purposes only, and are not to be construed as indicating or implying the relative importance. Thus, features defined by "first" and "second" may include one or more of the features either explicitly or implicitly.

Although the embodiments have been shown and described above, it should be understood that the above embodiments are merely exemplary and should not be construed as limiting. One skilled in the art may make changes, modifications, replacements and variations to the above embodiments within the scope of the present embodiments.

The invention claimed is:

1. A handle assembly for a refrigeration apparatus, the handle assembly being detachably assembled on either side of a cabinet door of the refrigeration apparatus, the handle assembly comprising: a handle, a handle bracket, and an elastic member, wherein the handle comprises a U-shaped handle portion and an extension on a side of the U-shaped handle portion, wherein the U-shaped handle portion is movably assembled in the handle bracket, wherein the U-Shaped handle portion of the handle is located within a first portion of the handle bracket defining a partial enclosure for the U-shaped handle portion, and the extension of the handle is assembled in a second portion of the handle bracket, and a protrusion is disposed at one end of the extension; wherein the elastic member is connected to the second portion of the handle bracket, and the extension of the handle is connected with the elastic member.

2. The handle assembly according to claim 1, wherein two sides of the extension of the handle engage in a buckle of the handle bracket and are slidable in the buckle.

3. The handle assembly according to claim 1, wherein the protrusion is substantially perpendicular to an extending direction.

4. The handle assembly according to claim 1, wherein the handle has two extensions, and the elastic member is connected between the two extensions.

5. The handle assembly according to claim 4, wherein the elastic member is a torsion spring.

6. The handle assembly according to claim 1, wherein the handle bracket is provided with a flange edge between the first portion and the second portion thereof.

7. The handle assembly according to claim 1, wherein the handle bracket is provided with screw holes on two sides of the second portion thereof.

8. The handle assembly according to claim 1, wherein the handle assembly further comprises a decorative sheet.

9. The handle assembly of claim 1 being mounted on the cabinet door of the refrigeration apparatus, such that a lock tongue of the cabinet door retracts to realize bi-directional opening of the cabinet door.

10. The handle assembly of claim 1, wherein the refrigeration apparatus comprises two refrigerating apparatuses disposed side by side, wherein the handle assembly is respectively assembled on adjacent sides of the two refrigerating apparatuses, such that the cabinet door of each of the adjacent sides can be opened in opposite directions.

* * * * *